United States Patent [19]

Kirk

[11] 4,398,760

[45] Aug. 16, 1983

[54] SUBMERSIBLE NET FOR HELICOPTER RESCUE MISSIONS

[76] Inventor: Vernon C. Kirk, 13120 Everglade, Clearlake Oaks, Calif. 95423

[21] Appl. No.: 262,547

[22] Filed: May 11, 1981

[51] Int. Cl.[3] ..... B66C 1/12

[52] U.S. Cl. ..... 294/77

[58] Field of Search ..... 294/77, 74, 67 E, 67 EA; 244/151 R; 182/138, 139

[56] References Cited

U.S. PATENT DOCUMENTS 3,827,745 8/1974 Pugh ..... 294/77

FOREIGN PATENT DOCUMENTS 316765 8/1929 United Kingdom ..... 294/77

*Primary Examiner*—James B. Marbert

*Attorney, Agent, or Firm*—Paul L. Hickman

[57] ABSTRACT

A rescue net characterized by a base ring, a rail ring, netting covering the base ring and extending between the base ring and rail ring, a hoist assembly, and a number of shroud lines coupling the rail ring to the hoist assembly. The base ring and the rail ring are provided with a number of holes so that they flood and sink upon contact with the water. This allows boating accident victims and the like to be scooped out of the water by lowering the net from a helicopter and dragging the net below the surface of the water towards the victim.

11 Claims, 6 Drawing Figures

FIG. 4
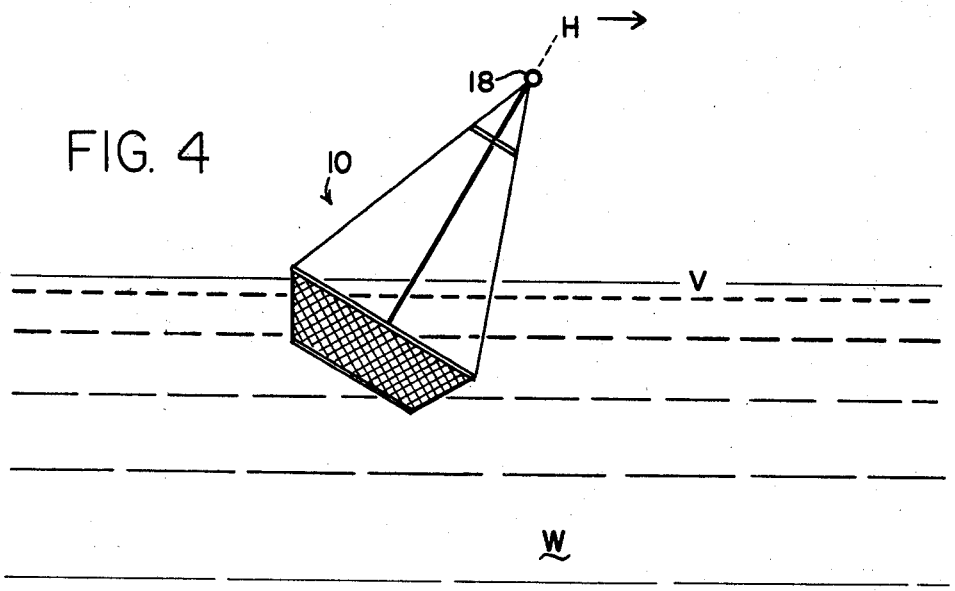
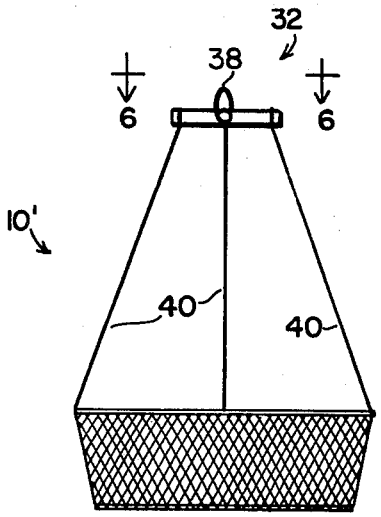
FIG. 5
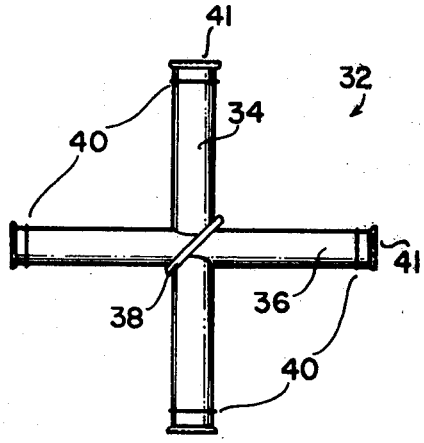
FIG. 6

SUBMERSIBLE NET FOR HELICOPTER RESCUE MISSIONS

BACKGROUND OF THE INVENTION

1. Field of the Invention

This invention relates generally to personnel and cargo nets and more particularly to rescue nets.

2. Description of the Prior Art

Rescues at sea are often accomplished by helicopter. If, for example, a person or persons are floating adrift due to the capsizing of their vessel or due to some other calamity, a rescue helicopter can be quickly dispached to come to their aid. The helicopter, upon arriving at the scene, will often lower a personnel or cargo net for the victims to clamber into. Unfortunately, the victims often have difficulty getting into the net, particularly during rough weather and high seas. Thus, more often than not, it is necessary for frogmen to jump into the water and assist the victims into the rescue nets.

The present need for frogmen in helicopter rescue missions is disadvantageous in that qualified frogmen may not be available at the time of the accident and that the frogmen take up room in the helicopter that could be used for the people being rescued. Also, the frogmen rescue technique is rather slow to the detriment and danger of the victims.

U.S. Pat. No. 2,827,325 of B. Pugh is illustrative of a personnel and cargo net that might be used in a helicopter rescue attempt. In his patent Pugh describes a net having a lower spreader ring, an upper spreader ring, and netting extending across the bottom of the lower spreader ring and between the upper and lower spreader rings. A pair of voids in the netting extending between the rings are providing for loading and unloading cargo and personnel. U.S. Pat. Nos. 3,827,745 and 3,165,346, also of Pugh, describe similar nets with the exception that the lower spreader ring is covered with a solid, floatable material.

A problem encountered when using a net such as Pugh's for a sea rescue mission is that the net must be at or near water level for a person to enter the voids in the sidewalls of the netting. Obviously, if the nets of Pugh were submersible the victims would not be able to enter the net except by diving underwater. To keep the net at the surface of the water the bases of the nets described in the two later patents issued to Pugh are solid and floatable. As mentioned above, frogmen are often required to assist the victims into such nets.

SUMMARY OF THE INVENTION

It is an object of this invention to provide a net that can be lowered from a helicopter to rescue victims of boating accidents and the like, and which does not require the use of frogmen to help the victims into the net.

It is a further object of this invention to provide a helicopter rescue net that can make a rescue-at-sea more efficient and less time consuming.

Another object of this invention is to provide a rescue net that is lightweight and that can be compactly stored in the hold of a helicopter.

Briefly, the invention includes a tubular base ring and a tubular rail ring, both rings being provided with a number of apertures formed through their surface, netting extending across the base ring and between the base ring and the rail ring, a hoist assembly, and a number of shroud lines coupling the rail ring to the hoist assembly. The rings are lightweight until lowered into the water, at which time they flood and sink. Since the top of the rail ring is uncovered a victim can be scooped from the water by positioning the submerged net under the victim and then raising the net.

Preferably, the rail ring is of a larger diameter than the base ring so that they can nestle together for compact storage. If the hold of the helicopter is especially small, or if more compact storage is desired, the rings can be disassebled into half rings.

The major advantage of this invention is that it is lightweight and easy to store, yet it will sink when placed into the water and can be used to scoop up sea-wrecked persons without the need for assistance by frogmen.

These and other objects and advantages of the present invention will no doubt become apparent upon a reading of the following descriptions and a study of the several figures of the drawing.

BRIEF DESCRIPTION OF THE DRAWING

FIG. 4 illustrates the use of the submersible rescue net.

FIG. 5 is a side elevational view of an alternate embodiment of a submersible rescue net.

FIG. 6 is a partial view taken along line 6—6 of FIG. 5.

DETAILED DESCRIPTION OF THE PREFERRED EMBODIMENT(S)

Figure 1:
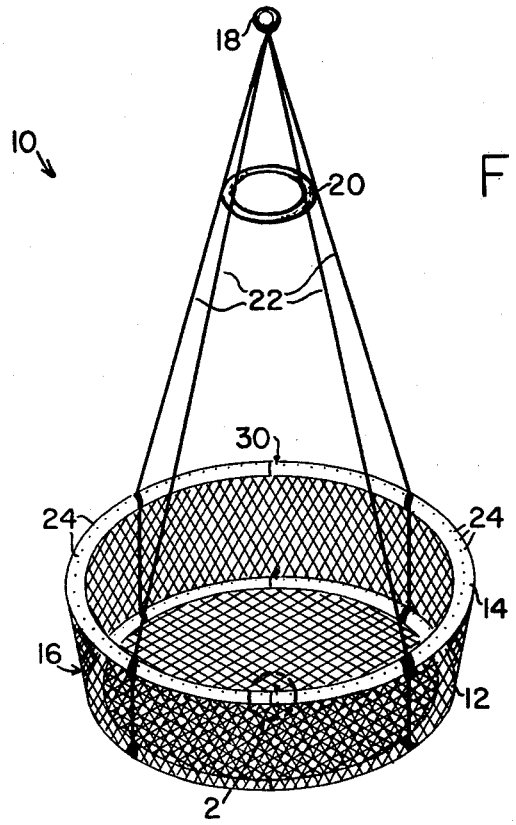
FIG. 1 is a perspective view of a submersible rescue net in accordance with the present invention.

Referring to the perspective view of FIG. 1, a submersible rescue net 10 includes a base ring 12, a rail ring 14, and netting 16 extending across the base ring and between the base ring and the rail ring. Net 10 further includes a hoist ring 18, a spreader ring 20, and shrouds 22 coupling the hoist ring to the rail ring and to the base ring.

Figure 2:
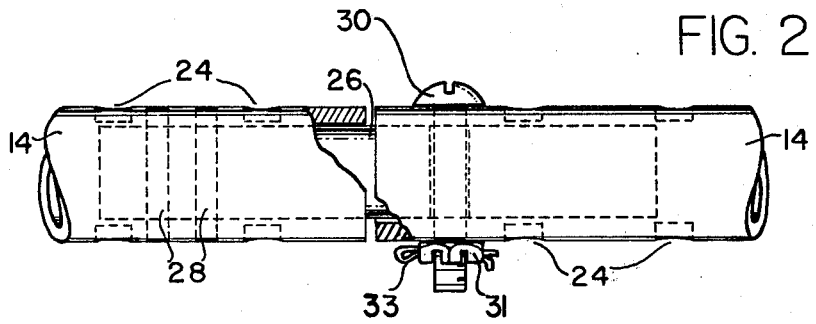
FIG. 2 is a detail view of the portion of FIG. 1 encircled by broken line 2.

With additional reference to FIG. 2, both the base ring and the rail ring are tubular in structure and are provided with a number of holes or apertures 24 that allow fluids to ingress and egress their interiors. As will be discussed subsequently, the tubular, apertured structure of the base and rail rings provide a strong, rigid, and lightweight framework for the netting that readily sinks when it contacts a large body of water.

Both the base ring and the rail ring are preferably constructed in two semi-circular pieces that are removably coupled together. As shown in FIG. 2, the removable coupling can comprise a connection member 26 having one end permanently attached within an end of one of the semi-circular pieces by rivits 28 or the like, and having its other end removably attached within an end of another semi-circular piece by a "clevis" bolt 30 or the like. The clevis bolt 30 shown in the figure is associated with a castle nut 31 and a cotter pin 33. The shrouds are preferably attached to the rings by a suitable knot, such as two half hitches.

Member 26 can further serve as ballast to help the rings sink faster when they hit the water. Other ballast members can be temporarily or permanently disposed within the tubular rings 12 and 14 for the same purpose. Of course, other types of ballasts, such as lead, could be melted and poured into the base and/or rail rings along part or all the perimeter of the ring to accomplish the same purpose.

Figure 3:
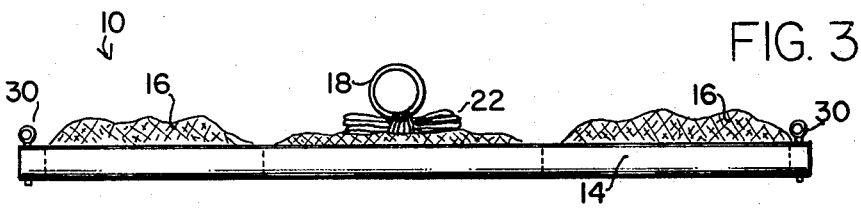
FIG. 3 is a side elevational view of a submersible rescue net compacted for storage.

In FIG. 3 the rescue net 10 is shown compactly collapsed for storage. In this embodiment the rail ring 14 has a larger internal diameter than the external diameter of base ring 12 so that the base ring nestles inside the larger rail ring. The spreader ring 20 fits within the base ring and the netting 16 is neatly bunched between the inner rings. The shroud lines are coiled to prevent tangling.

Should the hold of the helicopter be very small, or should the operator of the helicopter wish the submersible rescue net to be stored even more compactly, the clevis bolts 30 could be removed and the base ring and rail ring separated into their component halves. In its disassembled form the rescue net occupies approximately one-half the planar surface that it does in its assembled form.

The operation of the rescue net is best discussed with reference to FIG. 4. To rescue a victim V floating or swimming on the surface of a large body of water W a rescue net 10 is lowered from a helicopter H. The hoist ring 18 of the net is usually attached to a hook-and-winch assembly supported by a boom attached to the helicopter just outside of its cargo door. The rescue net is lowered to the surface of the body of water where the base and rail rings immediately flood and sink. The rescue net is towed underwater until it is under the victim, at which time the net is raised to scoop the victim out of the water. To facilitate this scooping action the sidewalls formed by the netting extending between the base and rail rings are kept quite low (usually 1–2 feet) in comparison the the length of the shroud lines. The net is then brought into the hold of the helicopter to unload the rescued victim. The procedure is repeated to rescue the remaining victims.

In FIGS. 5 and 6 an alternate embodiment 10' of the present invention is shown to include a novel hoist assembly 32 including a pair of tubular cross-bars 34 and 36 and a hoist ring 38. The shroud lines 40 are attached to the radially distal ends of the cross-bars. Caps 41 are attached over the ends of the cross bars to prevent them from filling with water. This configuration for the hoist assembly permits the hoist operator greater control over the movement of the rescue net during loading and unloading because the entire rescue net can be swiveled into and out of the cargo doors. This embodiment is also more desirable for land and building top rescues.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A submersible rescue net comprising:

a rigid, non-floatable tubular base ring provided with a plurality of apertures that allow a fluid in ingress and egress its interior;

a rigid, non-floatable tubular rail ring provided with a plurality of apertures that allow a fluid to ingress and egress its interior;

netting means extending across said base ring and between said base ring and said rail ring, whereby said netting forms a base and sidewalls when said rail ring is vertically separated from said base ring, and whereby the top of said rail ring is uncovered;

a hoist means; and a plurality of shroud lines coupling said rail ring to said hoist means.

2. A submersible rescue net as recited in claim 1 wherein one of said base ring and said rail ring is of sufficiently greater diameter than the other so that one may nestle inside the other for storage.

3. A submersible rescue net as recited in claim 2 wherein said plurality of shroud lines further couple said rail ring to said base ring.

4. A submersible rescue net as recited in claim 3 wherein said hoist means includes a hoist ring adapted to removably attach to a hook of a helicopter winch assembly.

5. A submersible rescue net as recited in claim 4 wherein each of said said base ring and said rail ring include a pair of semi-circular tubular members, and means for removably coupling said semi-circular tubular members together.

6. A submersible rescue net as recited in claim 1 further comprising ballast means inserted within at least one of said base ring and said rail ring.

7. A submersible rescue net comprising:

a tubular base ring assembly provided with a plurality of apertures that allow a fluid to ingress and egress its interior; said base ring assembly including a pair of semi-circular base ring portions removably attached together at their ends by a pair of base ring couplers; wherein each of said pair of base ring couplers includes a base ring attachment member having a first end section attached within an end of a first base ring portion, and means for removably attaching a second end section of said base ring attachment member within an end of a second base ring portion;

a tubular rail ring assembly provided with a plurality of apertures that allow a fluid to ingress and egress its interior; wherein one of said base ring assembly and said rail ring assembly is of sufficiently greater diameter than the other so that one may nestle inside the other for storage; said rail ring assembly including a pair of semi-circular rail ring portion removably attached together at their ends by a pair of rail ring couplers; wherein each of said pair of rail ring couplers includes a rail ring attachment member having a first end section attached within an end of a first rail ring member, and means for removably attaching a second end section of said attachment member within an end of a second rail ring assembly portion;

netting means extending across said base ring assembly and between said base ring assembly and said rail ring assembly, whereby said netting forms sidewalls and a base when said rail ring assembly is vertically separated from said base ring assembly, and whereby the top of said rail ring assembly is uncovered;

a hoist means including a hoist ring adapted to removably attach to a hook of a helicopter winch assembly; and a plurality of shroud lines coupling said rail ring assembly to said hoist means and said base ring assembly.

8. A submersible rescue net as recited in claim 7 wherein said hoist means further includes a spreader member attached to said shroud lines between said hoist ring and said rail ring assembly.

9. A submersible rescue net as recited in claim 8 wherein said spreader member is ring shaped.

10. A submersible rescue net as recited in claim 8 wherein said spreader member is cross shaped, and wherein said hoist ring is attached to the central juncture of the spreader member.

11. A submersible rescue net as recited in claim 8 further comprising ballast means inserted within at least one of said base ring assembly and said rail ring assembly.

* * * * *